United States Patent [19]

Suzuki et al.

[11] 4,350,750

[45] Sep. 21, 1982

[54] ELECTROPHOTOGRAPHIC PROCESS

[75] Inventors: Shigeru Suzuki; Minoru Suzuki; Koichi Suzuki; Kyoji Omi; Yasumori Nagahara; Yoshiharu Kagari; Makoto Hashimoto; Goro Mori, all of Tokyo, Japan

[73] Assignee: Ricoh Company, Ltd., Tokyo, Japan

[21] Appl. No.: 177,974

[22] Filed: Aug. 14, 1980

Related U.S. Application Data

[63] Continuation of Ser. No. 760,891, Jan. 21, 1977, abandoned.

[30] Foreign Application Priority Data

Jan. 23, 1976 [JP] Japan ..... 51-6865

[51] Int. Cl.[3] ..... G03G 13/22; G03G 21/00

[52] U.S. Cl. ..... 430/125; 430/31; 430/126; 430/22; 430/952; 134/1; 355/3 DR; 355/3 BE; 355/15

[58] Field of Search ..... 430/31, 125, 126, 22, 430/952; 134/1; 355/3 DR, 3 BE, 15

[56] References Cited

U.S. PATENT DOCUMENTS

| | | | |
|---|---|---|---|
| 2,911,330 | 11/1959 | Clark | 430/125 |
| 3,041,167 | 6/1962 | Blakney | 430/125 |
| 3,141,394 | 7/1964 | Cunningham et al. | 430/31 |
| 3,615,813 | 10/1971 | Clarke et al. | 134/1 |
| 3,637,306 | 1/1972 | Cooper | 355/15 |
| 3,640,707 | 2/1972 | Caldwell | 430/125 X |
| 3,778,148 | 12/1973 | Fujitsuka et al. | 355/15 |

OTHER PUBLICATIONS

Warter, "Factors Determining Xerographic Photoreceptor Performance," Applied Optics, Supplement 3: Electrophotography, 1969, pp. 65-75.

*Primary Examiner*—Roland E. Martin, Jr.
*Attorney, Agent, or Firm*—Jordan and Hamburg

[57] ABSTRACT

Either a single copy or a plurality of copies of an original document may be made. Making a single copy or the last copy of a plurality of copies comprises, during a first revolution of a photoconductive drum, electrostatically charging the drum, radiating a light image of the document onto the drum to form an electrostatic image, developing the electrostatic image using a magnetic brush to form a toner image, transferring the toner image to a copy sheet, electrostatically discharging the drum and uniformly radiating the drum with light to further discharge the same. During a second revolution of the drum the drum is cleaned with the same magnetic brush to remove residual toner, and again electrostatically discharged and uniformly radiated. During a third revolution of the drum the magnetic brush is again used for cleaning. For making all but the last of a plurality of copies, the drum is charged, imaged, transferred and electrostatically discharged during a first revolution thereof and cleaned with the magnetic bruch during a second revolution. Whether the process is used to make one or more copies, the same portion of the drum is always used. Subsequently, the drum rotation is indexed so that the next process will use a different portion of the drum.

4 Claims, 4 Drawing Figures

ELECTROPHOTOGRAPHIC PROCESS

This is a continuation of application Ser. No. 760,891, filed Jan. 21, 1977, abandoned.

BACKGROUND OF THE INVENTION

The present invention relates to an electrophotographic process for selectively making either a single copy or a plurality of copies from an original document.

The basic electrophotographic process to which the present invention constitutes a substantial improvement generally comprises electrostatically charging a photoconductive drum, radiating a light image onto the drum to form an electrostatic image through localized photoconduction, developing the image through the application of a developing or toner substance to produce a toner image, transferring and fixing the toner image to a copy sheet to provide a permanent copy and cleaning residual toner from the drum.

It has become popular to utilize a magnetic brush for applying the toner substance to the drum. A magnetic brush comprises a rotating magnetic core to which is magnetically adhered the toner substance. The drum is rotated in brushing engagement with the magnetic brush so that the toner is attracted and adheres to the high charge or dark areas of the electrostatic image.

Whereas separate means have been proposed to clean the drum, or remove residual toner substance therefrom after the transfer operation, it is advantageous to utilize the same magnetic brush which is used in the developing step after electrostatically discharging and/or uniformly radiating the drum with light to dissipate the electrostatic image. Such an arrangement provides a compact, economical and low maintenance copying machine since a separate cleaning means is eliminated. In addition, the arrangement provides automatic recycling of the residual toner substance.

However, a problem has remained heretofore unsolved which has required a design decision to made as to whether to tolerate ineffective cleaning and the resultant double printing or whether to increase the complexity of the machine to provide satisfactory cleaning. More specifically, the consecutive steps of electrostatically discharging, uniformly radiating and cleaning the drum with the magnetic brush are insufficient to effectively clean the drum. This is because a bias voltage is applied to the magnetic brush which is suitable for the developing step. This bias voltage is on the order of the electrostatic potential in the light areas of the electrostatic image so as to prevent the white areas of the copies from appearing gray. This bias voltage is not high enough to allow the magnetic brush to be effective during the cleaning step. If the bias voltage is increased during the developing step, the electrostatic image on the drum will be seriously degraded resulting in unacceptable copying quality.

Adding additional components to increase the bias voltage during the cleaning step only requires a dual potential bias voltage source and automatically synchronized switching means which add considerably to the complexity and cost of the copying machine and offset the advantage of utilizing the magnetic brush both for developing and cleaning.

Furthermore, in high toner density areas of the drum, it is impossible to completely discharge the drum by means of the corona discharge unit which is widely used. This is because the residual toner accumulation is so thick in these areas that the corona produced ions cannot penetrate through the toner substance to the drum. Whereas the uniform light radiation aids the discharge process through partial penetration of the light through the toner substance resulting in photoconduction, substantially complete discharge cannot occur unless the light intensity is extremely great. Such a high light intensity causes fatigue of the photoconductive layer of the drum resulting in extremely degraded copy quality, especially in multiple copy operations.

SUMMARY OF THE INVENTION

The present invention provides a process for making either a single copy or a plurality of copies from an original document as desired utilizing a simplified apparatus and without sacrificing copy quality. Making a single copy or the last copy of a plurality of copies comprises, during a first revolution of a photoconductive drum, electrostatically charging the drum, radiating a light image of the document onto the drum to form an electrostatic image, developing the electrostatic image using a magnetic brush to form a toner image, transferring the toner image to a copy sheet, electrostatically discharging the drum and uniformly radiating the drum with light to further discharge the same. During a second revolution of the drum the drum is cleaned with the same magnetic brush to remove residual toner, and again electrostatically discharged and uniformly radiated. During a third revolution of the drum the magnetic brush is again used for cleaning. For making all but the last of a plurality of copies, the drum is charged, imaged and transferred and electrostatically discharged during a first revolution thereof and cleaned with the magnetic brush during a second revolution. Finally, the drum rotation is indexed so that the next process will use a different portion of the drum.

It is an object of the present invention to utilize a basic apparatus to effect satisfactory removal of residual toner from the drum without sacrificing copying speed. Whereas electrostatic discharge and magnetic brush cleaning steps, as used to make all but the last of a plurality of copies, are insufficient to remove all residual toner from non-image areas of the drum, they are sufficient to remove substantially all residual toner from the image areas. Whereas repeating these operations, in conjunction with uniform light radiation will remove all residual toner from the non-image areas of the drum, such would unnecessarily slow down the copying process. However, since all copies utilizing a process of the invention are made on the same area of the drum, it is unnecessary to remove all residual toner from the non-image areas and high quality copies can be made using only the discharge and cleaning steps for residual toner removal. After the last copy is made, the steps are repeated to clean the entire drum.

It is another object of the invention to prevent localized fatigue of the drum caused by uniform light illumination during the cleaning process. This is accomplished by indexing the drum so that different portions thereof will be used for consecutive copying processes.

It is another object of the invention to provide a copying process which can be embodied in a simplified manner, thereby effecting substantial economies in commercial production.

It is another object of the present invention to provide a generally improved electrophotographic process.

Other objects, together with the foregoing, are attained in the process described in the following description and illustrated in the accompanying drawing.

DESCRIPTION OF THE PREFERRED EMBODIMENT

While the electrophotographic process of the invention is susceptible of numerous physical embodiments, depending upon the environment and requirements of use, substantial numbers of the herein shown and described embodiment have been made, tested and used, and all have performed in an eminently satisfactory manner.

Figure 1:
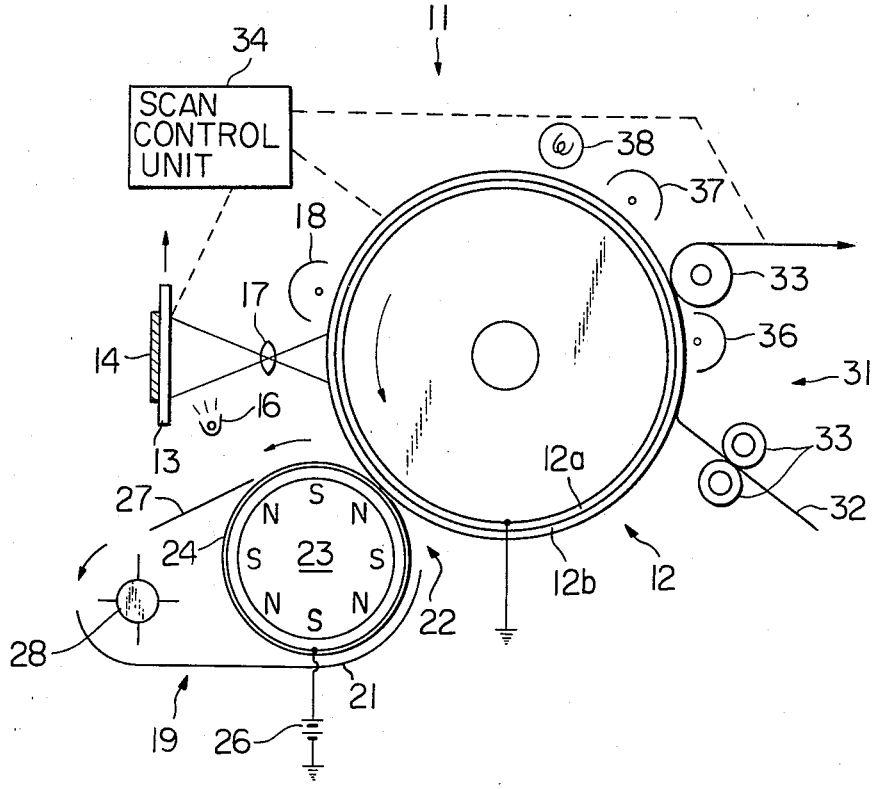
FIG. 1 is simplified schematic illustration of an electrostatic copying apparatus for practicing the process of the present invention; and FIGS. *2a* to *2c* are diagrams illustrating a photoconductive drum of the apparatus as flattened out, which facilate understanding of an indexing step of the present process.

Referring now to FIG. 1 of the drawing, an electrophotographic apparatus or copying machine for practicing the present process is generally designated by the reference numeral 11. The copying machine 11 comprises a drum 12 which is rotated counterclockwise at constant speed by a drive motor (not shown). The drum 12 comprises an electrically conductive core 12*a* which is grounded to earth and a photoconductive layer 12*b* formed on the circumference of the core 12*a*.

A transparent platen 13 is disposed facing the drum 12 which is adapted to be driven for scanning by a feed mechanism (not shown) relative to the drum 12 at the same surface speed thereof. An original document 14 for electrostatic duplication is placed face down on the platen 13 (facing the drum 12) and selectively illuminated by means of a lamp 16. A converging lens 17 projects and focusses a light image of the document 14 onto the surface of the drum 12.

Upstream of the lens 17 in the direction of rotation of the drum 12 is a corona charging unit 18 for electrostatically charging the surface of the drum 12 in the dark. The light image of the document 14 produces localized photoconduction of the drum 12 to form an electrostatic image thereon. A developing unit 19 is disposed downstream of the lens 17 to apply a developing or toner substance to the drum 12 to develop the electrostatic image into a toner image. The developing unit 19 comprises a developing tank 21 which contains the toner substance, which is typically constituted by dark colored toner particles of resin mixed with a carrier of ferromagnetic particles. The toner particles are electrostatically charged with a polarity opposite to the charge of the electrostatic image on the drum 12 so that the toner particles are attracted to the dark areas of the electrostatic image in which minimum photoconduction occurs during the imaging process.

The developing unit 19 is of the magnetic brush type comprising a magnetic brush 22 consisting of a magnetic core 23 coaxially surrounded by a non-magnetic cylinder 24. Either or both of the core 23 and sleeve 24 are rotated so that the toner substance is magnetically attracted and adhered to the periphery of the cylinder 24. The adhered toner substance rotates counterclockwise in brushing engagement with the drum 12 thereby applying the toner substance to the surface of the drum 12. A bias voltage source symbolically illustrated as a battery 26 applies a voltage to the cylinder 24 which is substantially equal to the potential of the light or white image areas on the drum 12. This bias voltage prevents toner from being electrostatically attracted to these areas so that the white image areas of the document 14 reproduce as white on the copies.

The developing unit 19 further comprises a doctor blade 27 which removes excess toner from the cylinder 24 and returns it to the developing tank 21 for recycling. A rotary agitator 28 homogenizes the toner substance in the developing tank 21. Toner is added to the tank 21 periodically by any convenient means for replenishment.

Downstream of the developing unit 19 is a transfer unit 31 which serves to transfer the toner image from the drum 12 to a copy sheet 32. The copy sheet 32 is fed in contact with the surface of the drum 12 by feed rollers 33 in such a manner that the copy sheet 32 moves at the same speed as the surface of the drum 12. A scan control unit 34 of any known construction controls the scanning operation of the platen 13, the rotation of the drum 12 and the movement of the feed rollers 33. A corona transfer charger 36 is disposed behind the copy sheet 32 to apply an electrostatic potential thereto of a polarity which is the same as that of the electrostatic image on the drum 12, but higher in magnitude, and opposite to the polarity of the toner particles to urge the toner image from the drum 12 onto the copy sheet 32. Subsequently, the toner image is thermally or otherwise fixed to the copy sheet 32 to provide a permanent reproduction of the document 14 although the means for performing said fixing operation are not shown.

Downstream of the transfer unit 31 is a corona discharging unit 37 for applying an electrostatic potential opposite in polarity to the electrostatic image on the drum 12 to discharge the drum 12 and a lamp 38 to continuously illuminate the drum 12 and further discharge or dissipate the electrostatic image thereon through photoconduction. Although not specifically shown or described, it is understood that the copying machine 11 comprises a main control unit to activate and deactivate the various component parts of the machine 11 in the desired manner.

To make a single copy of the original document 14, the drum 12 is charged by the charging unit 18, and the drive means for the platen 13 and the lamp 16 are energized by the scan control unit 34 to illuminate and move the document 14 relative to the drum 12 thereby producing an electrostatic image of the document 14 on the drum 12. This electrostatic image is developed to produce a toner image by the developing unit 19. The toner image is transferred to the copy sheet 32 by the transfer unit 31. Subsequently, the drum 12 is electrostatically discharged by the discharging unit 37 and uniformly illuminated with light by the lamp 38 to further discharge the drum 12. All of these operations are performed during a first revolution of the drum 12.

After the imaging operation is completed the scan control unit 34 de-energizes the lamp 16 and returns the platen 13 to an initial position. However, the drum 12 continues to rotate through a second revolution in which the magnetic brush 22 continues to brushingly contact the drum 12. Since the drum 12 is at least partially discharged, a certain amount of residual toner substance which was not transferred to the copy sheet 32 will be removed by the magnetic brush 22 and returned to the developing tank for recycling. The agitator 28 thoroughly mixes the recycled toner with the toner in the tank 21 to homogeneity.

However, since the bias voltage on the magnetic brush 22 is only sufficient to properly accomplish the developing function and the drum 12 is not completely discharged by the discharging unit 37 and lamp 38 as described hereinabove in the non-image areas of the drum 12, it is necessary to repeat the cleaning process. In practice, it has been found that two cleaning operations comprising discharging by the discharging unit 37, illumination by the lamp 38 and cleaning by the magnetic brush 22 are sufficient to remove substantially all of the residual toner substance from the non-image areas of the drum 12 even with the low bias voltage on the magnetic brush 22.

Therefore, during the second revolution of the drum 12, the drum 12 is cleaned by the magnetic brush 22, again discharged by the discharging unit 37 and illuminated by the lamp 38. During a third revolution of the drum 12, the drum 12 is cleaned for a second time by the magnetic brush 22. During the third revolution of the drum 12 it is possible to again utilize the discharging unit 37 and lamp 38 although it is generally unnecessary.

The operation of producing the last copy of a plurality of copies of the same original document 14 is identical to that described above for making a single copy. However, if complete operations were performed for each copy of a plurality of copies prior to the last copy, the copying operation would become too slow for most practical applications.

However, in accordance with the present invention, the copying operation is speeded up for multiple copies without sacrificing copying speed or significantly increasing the complexity of the mechanism. This is accomplished by means of the scan control unit 34 which synchronizes the operation of the machine 11 in such a manner that the process utilizes the same portion of the drum 12 throughout a multiple copying operation.

For all but the last copy where a plurality of copies are made of the same document 14, the drum 12 is charged by the charging unit 18, imaged by the lens 17, developed by the developing unit 19 and the toner image is transferred to the copy sheet 32 by the transfer unit 31. The drum 12 is then discharged by the discharging unit 37. However, the lamp 38 is not energized in order to reduce fatigue of the photoconductive layer **12*b* of the drum 12 which would cause degradation of the copying quality. This is an important advantage of the present invention. During a second revolution of the drum 12, the only operation performed is cleaning the drum 12 by the magnetic brush 22**.

Whereas discharging by the discharging unit 37 and cleaning by the magnetic brush 22 are insufficient to remove all residual toner from non-image areas of the drum 12, these operations remove sufficient residual toner from the image areas of the drum 12 so that multiple copies of excellent quality may be produced. It is not especially critical that all toner be removed from the image areas since the image is always formed at the same place on the drum 12 and double printing will not be noticable. Whereas in copying machines known heretofore the only synchronization accomplished is to ensure that the leading edge of the toner image on the drum 12 aligns with the leading edge of the copy sheet, consecutive images are formed on different portions of the drum. For this reason, it is necessary to remove all toner substance from the drum, since the image area of a subsequent copy will overlap the non-image area of a previous copy.

With the present invention, however, high quality copies can be produced, in multiple copying operations, in only two revolutions of the drum 12 rather than three revolutions as would be required with a prior apparatus, therefore speeding up the copying operation with the present simple and economical apparatus to a considerable extent. Of course, after the last copy has been made the cleaning operation is performed twice utilizing the lamp 37 to completely clean the drum 12.

Figure 2A:
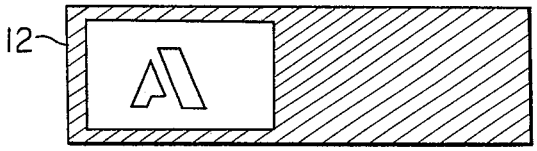
Figure 2B:
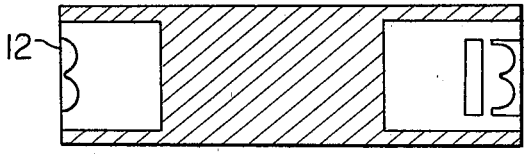

Another important feature of the present invention is illustrated in FIGS. **2*a* to 2*c*, which show the drum 12 as flattened out. FIG. 2*a* illustrates a process in which one or more copies is made of an original document bearing the letter "A". The non-image or border areas of the drum 12 are indicated by hatching. As can be seen in FIG. 2*a*, all copies of the document are made in a portion of the drum 12 near the left edge of the drum 12**.

Figure 2C:
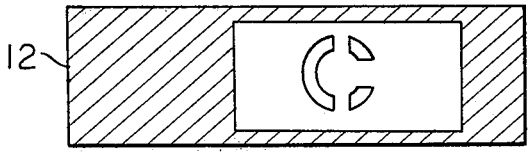

After the process for copying the document bearing the letter "A" is completed, the scan control unit 34 indexes the rotational relationship of the drum 12 relative to the scanning operation of the platen 13 and the operation of the transfer unit 31 so that a different portion of the drum 12 is used for copying operations of an original document bearing the letter "B" as shown in FIG. **2*b*. As shown, the new image area partially overlaps the previous image area. After the copying process for the document bearing the letter "B" is completed, the drum 12 rotation is again indexed so that during a subsequent copying process for an original document bearing the letter "C" as shown in FIG. 2*c*, yet another portion of the drum 12** is utilized.

As mentioned above, the use of the lamp 38 causes fatigue of the photoconductive layer **12*b* of the drum 12 which degrades the copy quality. However, by means of the indexing operation which preferably indexes the drum 12 by a distance which is not a multiple or submultiple of the length of the image thereon, the fatigue of the drum 12 is not localized but evenly distributed over the entire drum 12. Of further significance is the fact that although a particular portion of the drum 12 may be used many times for producing multiple copies of a single original document, the lamp 38 is only used for the last copy. In other words, the lamp 38 is used to the same extent during any copying process, regardless of whether one or a large number of copies are produced during the process, and the fatigue of the drum 12** is made truly uniform.

In summary, it will be seen that the present invention provides a unique process which permits the use of a simple apparatus to produce high quality copies without sacrificing copying speed. In addition, the process ensures that the fatigue of the photoconductive drum used in the process occurs in a completely uniform manner, thereby eliminating localized areas of low quality reproduction in copies. Many modifications will become possible for those skilled in the art after receiving the teachings of the present disclosure without departing from the scope thereof.

What is claimed is:

1. An electrophotographic process for making a plurality of copies from an original document utilizing a photoconductive member comprising:

(I) making the last copy of said plurality of copies utilizing the steps of:

(a) electrostatically charging the photoconductive member;

(b) radiating a light image of the original document onto the photoconductive member to form an electrostatic image thereon;

(c) applying a developing substance by means of a magnetic brush to the photoconductive member to produce a toner image thereon;

(d) transferring the toner image to a copy sheet;

(e) electrostatically discharging the photoconductive member;

(f) uniformly radiating the photoconductive member with light to further discharge the photoconductive member;

(g) cleaning the photoconductive member by means of the same magnetic brush;

(h) electrostatically discharging the photoconductive member;

(i) uniformly radiating the photoconductive member with light to further discharge the photoconductive member;

(j) cleaning the photoconductive member by means of the same magnetic brush;

(II) making all but the last copy of said plurality of copies comprising only steps (a), (b), (c), (d), (e) and (j);

(III) performing steps (b) and (d) on the same portion of the photoconductive member both for making said last copy as set forth in step (I) and for making all but the last copy of said plurality of copies as set forth in step (II);

(IV) subsequently, after completing steps (I), (II) and (III), indexing the photoconductive member a distance which is other than a multiple or submultiple of the length of the image thereon to provide a new image area partially overlapping the previous image area; and (V) making one or more further copies utilizing said new image area such that the making of said one or more further copies operates on a different successive overlapping portion of the photoconductive member, whereby fatigue of the drum is uniformly distributed over different successive overlapping portions of the photoconductive member and localized fatigue is thereby precluded.

2. A process according to claim 1 wherein said step (V) of making one or more further copies comprises making a single copy by repeating step (I).

3. A process according to claim 1 wherein said step (V) of making one or more further copies comprises making a plurality of further copies by repeating steps (I), (II), and (III).

4. A process according to claim 1 wherein subsequently, after completing steps (I), (II), (III), (IV) and (V), performing the following additional steps of:

(VI) indexing the photoconductive member again a distance which is other than a multiple or submultiple of the length of the second said image thereon to provide a further third new image area partially overlapping the previous second said image area, and (VII) making one or more yet further additional copies utilizing said third new image area such that the making of said one or more yet further additional copies operates on yet a different successive overlapping portion of the photoconductive member, whereby fatigue of the drum is uniformly distributed over the entire photoconductive member.

* * * * *